US006957945B2

(12) United States Patent
Tong et al.

(10) Patent No.: US 6,957,945 B2
(45) Date of Patent: Oct. 25, 2005

(54) SYSTEM TO CONTROL AXIAL THRUST LOADS FOR STEAM TURBINES

(75) Inventors: Wei Tong, Clifton Park, NY (US); Christian L. Vandervort, Voorheesville, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/306,193

(22) Filed: Nov. 27, 2002

(65) Prior Publication Data

US 2004/0101395 A1 May 27, 2004

(51) Int. Cl.[7] ..... F04D 27/00
(52) U.S. Cl. ..... 415/1; 415/28; 415/104
(58) Field of Search ..... 415/1, 26, 27, 415/28, 104, 106, 144, 145, 105, 406

(56) References Cited

U.S. PATENT DOCUMENTS 3,565,543 A 2/1971 Mrazek
4,152,092 A 5/1979 Swearingen
4,557,664 A 12/1985 Tuttle et al.
4,917,570 A * 4/1990 Pankowiecki et al. ..... 415/104
6,131,910 A * 10/2000 Bagepalli et al. ..... 277/355

* cited by examiner

*Primary Examiner*—Edward K. Look
*Assistant Examiner*—Dwayne White
(74) *Attorney, Agent, or Firm*—Polster, Lieder, Woodruff & Lucchesi, L.C.

(57) ABSTRACT

Apparatus (10) controls net thrust in a steam turbine (T) in response to changes in the operating condition of the turbine. The turbine includes a thrust bearing (B) positioned between low and intermediate pressure sections (LP, IP) of the turbine and a high pressure section (HP) thereof. Sensors (14) for sense thrust loads on the thrust bearing. A number of control valve (CV1–CV4) are used to balance pressures occurring at locations within the high pressure section of the turbine. A controller (16) is responsive to the sensors sensing a change within the turbine indicative of a significant change in net thrust to energize one or more of the control valves and to adjust the pressure within the high pressure section of the turbine so to maintain net thrust within an acceptable range of thrust values.

23 Claims, 4 Drawing Sheets

REGION I - THRUST RANGE UNDER NORMAL CONDITIONS (TOWARDS IP/LP)
REGION II - THRUST RANGE UNDER NORMAL CONDITIONS (TOWARDS HP)
REGION III - EXTENDED THRUST RANGE UNDER FAULT CONDITIONS (TOWARDS HP)
REGION IV - EXTENDED THRUST RANGE RANGE FAULT UNDER FAULT CONDITIONS (TOWARDS IP/LP)

SYSTEM TO CONTROL AXIAL THRUST LOADS FOR STEAM TURBINES

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention generally relates to steam turbines; and more specifically, to the development of a control system for stabilizing loading on thrust bearings within the turbine to maintain thrust levels within an acceptable range of values and avoid damage to the thrust bearings.

In a rotating turbomachine, thrust is an axial force acting on the rotating parts. Thrust is caused by unequal pressures acting over unequal surface areas, and changes in momentum of the fluid (steam) circulating through the machine. The sum of all axial forces acting on the rotating components of the turbine is referred to as "net thrust". This net thrust is transmitted to a stationary thrust bearing which, in turn, is anchored to a foundation for the turbine engine. The thrust developed by the turbine has two components. These are:

(a) Stage thrust which is thrust resulting from the pressure distribution around a stage bucket (blade), a cover, a wheel, etc. Stage thrust is usually in the direction of steam flow.

(b) Step thrust which results from variations in the diameter of the shaft to which the buckets are mounted, and the local pressure at points along the length of the turbine.

Conventional methods for controlling thrust in a steam turbine include: 1) using a balance piston at the high pressure (HP) section, 2) varying the rotor diameter in each section, 3) varying the number of stages comprising each section, and 4) establishing an appropriate configuration for each the low pressure (LP) intermediate pressure (IP), and high pressure (HP) sections of the turbine. However, all currently available methods only control thrust under "normal" operating conditions. As an engine design is completed, and its operating conditions are fixed, the net thrust of the steam turbine is specified. The methods set out above cannot now dynamically or actively adjust the steam turbine's net thrust, either under normal conditions or during fault operations.

A previous attempt at controlling thrust in a steam turbine is shown U.S. Pat. No. 4,557,664 to Tuttle, where there is disclosed use of a sealed balance piston on an overhung shaft end. The piston can be vented to an ambient pressure to balance the thrust, or vented to another control pressure to counteract any other net unbalanced forces acting across the turbine. For gas turbines, positive pressure has been used to help equalize a pressure differential across a rotor shaft. Approaches using exhaust air or gas are described in U.S. Pat. No. 3,565,543 to Mrazek and U.S. Pat. No. 4,152,092 to Swearingen.

Though such pressure equalizing features help minimize axial thrust variations during normal operations, none control net thrust for turbines operating under fault conditions. This is because the above-mentioned approaches control thrust "statically" rather than "dynamically." To control thrust dynamically, new techniques need be developed to satisfy the requirements of the power industry.

A number of fault operating conditions have the potential of creating large thrust forces. These include:

a) Intercept valve closed condition

All reheat turbines have an intercept valve and a reheat valve connected in series between a reheater and the intermediate and low pressure sections of the steam turbine. Both valves are normally open to allow steam flow through the unit. The reheat valve acts to throttle steam flow through the reheat section following a loss of electrical load, this preventing an over speed trip of the turbine. If turbine speed continues to rise, the unit trips and the intercept valve shuts off to prevent steam flow from the reheater into a reheat turbine. An intercept valve closed condition also exists when either the intercept valve or reheat valve closes during full load operation, in response to a control system malfunction. This can result in a very large thrust load since both the intermediate and low pressure stage thrusts go to zero, while the high pressure stage thrust remains at its original level. The condition may cause a thrust reversal. That is, net thrust suddenly changes its direction from negative to positive producing a large impulse on the thrust bearing.

b) Sudden opening of control valves

When a turbine is lightly loaded, flow through the high pressure and reheat sections is relatively small. Increase in load are normally accomplished through a slow and steady opening of the control valves at a specified rate. However, if the control valves malfunction and open quickly, a high flow through the high pressure section immediately occurs. Flow through the reheat section also builds up, but with a certain lag in time due to the volume of the reheater and its associated piping. Under this condition, the thrust in the high pressure section is much higher than the reheat thrust, resulting in a large thrust load acting on the thrust bearing in the direction of high pressure flow.

c) Bottled up

When a turbine trips, the intercept valve and main stop valves of the turbine shut off at approximately the same time. All flow to the turbine stops. The high pressure and reheat sections eventually empty out into a condenser and the pressures in these sections decrease to that of the condenser. If, however, steam in the high pressure section becomes trapped between the stop valve and intercept valve, a "bottle up" occurs. Initially, the bottled up pressure equals the mean reheat pressure for normal operation. But, due to stored heat in the boiler, the pressure of the bottled up steam rises until reheat safety valves open. The opening pressure of these valves is about 1.25 times the cold reheat pressure and is the highest possible pressure in the high pressure section of the turbine.

d) Seismic event

Seismic thrust is a force acting on the thrust bearing when the turbine experiences seismic vibrations. Seismic activity is described by the maximum acceleration as a fraction of the gravity of acceleration $g$. This seismic thrust is superimposed on the normal thrust.

To meet useful life requirements for a thrust bearing, its loading is kept within certain limits. Under normal operating conditions, thrust bearing loading must be lower than 400 psi (for a pivoted type thrust bearing) but larger than 50 psi. A setting of 50 psi avoids thrust reversal if temporary changes within the turbine upset the normal balance of forces. Second, if an intercept valve closes, the maximum allowable loading increases to 600 psi. Third, for seismic events, the maximum allowable loading is 1,800 psi.

BRIEF SUMMARY OF THE INVENTION

Briefly stated, the present invention is directed to the control of axial thrust loads in a steam turbine. This is accomplished by controlling a pressure differential across a balance piston in a high pressure section of the turbine in response to variations in net thrust. An apparatus of the invention controls net thrust in the turbine in response to changes in the operating condition of the turbine. The turbine includes a thrust bearing installed between the low and intermediate pressure sections of the turbine and the high pressure section. Load sensors installed on opposite side of the thrust bearing sense thrust loads on the bearing. A plurality of control valves act to balance pressures occurring at locations within the high pressure section. A controller is responsive to the sensors sensing a change within the turbine indicative of a significant change in net thrust to activate one or more of the control valves so to adjust the pressure within the high pressure section and maintain the net thrust within an acceptable range of thrust values.

Although primarily designed for controlling axial thrust in the high pressure section of the turbine, the invention can be implemented in other sections of the turbine as well.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
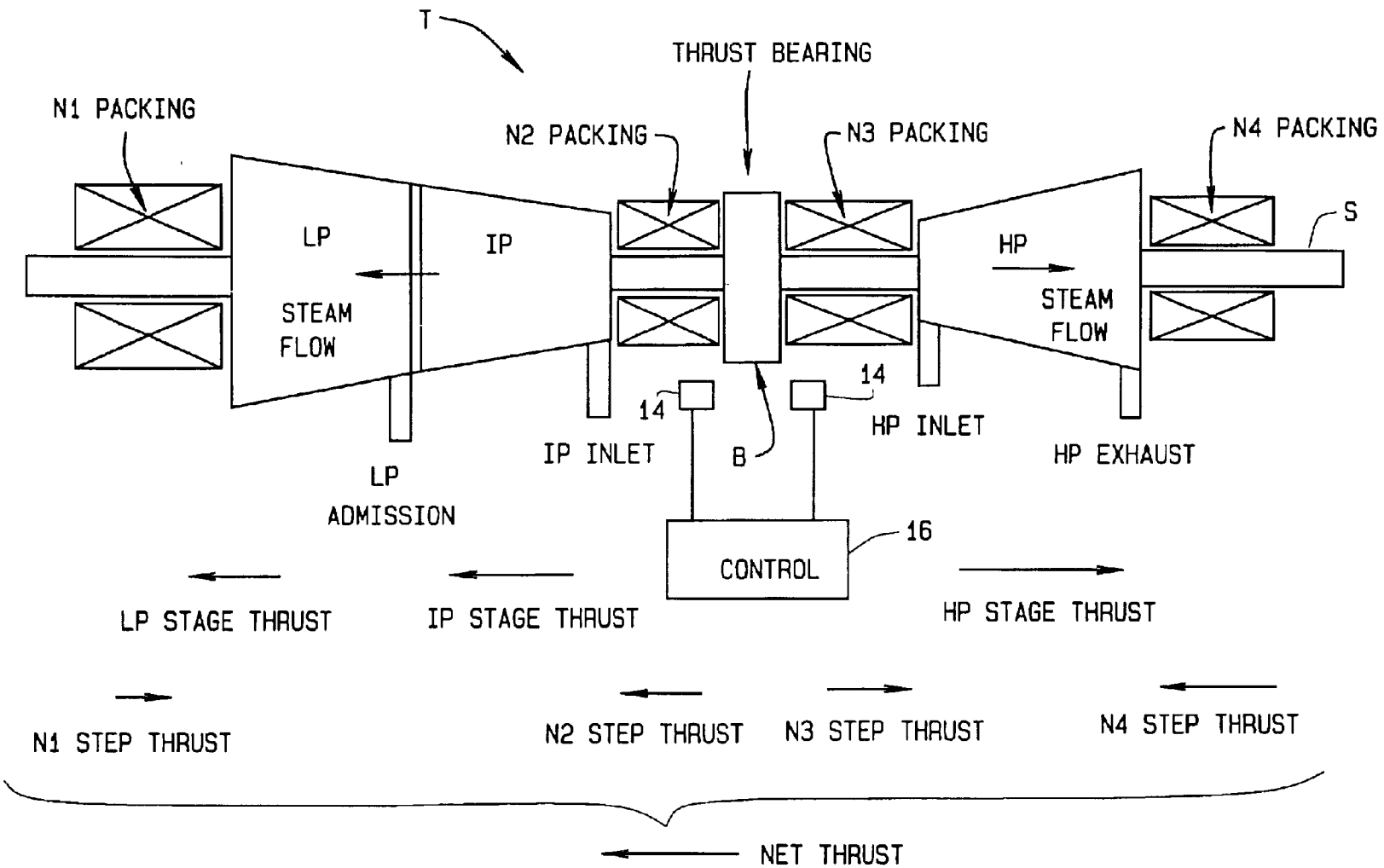
FIG. 1 is a simplified representation of a steam turbine.

In accordance with the present invention, the net thrust load of a steam turbine is controlled by controlling the pressure differential across a balance piston in a high pressure section of the turbine in response to net thrust variation. Referring to FIG. 1, a turbine T is shown to be comprised of a high pressure section HP, an intermediate pressure section IP, and an adjacent low pressure section LP. Each section may be comprised of one or more stages. The rotating elements housed within these various stages are commonly mounted on an axial shaft or rotor S. As shown in FIG. 1, high pressure section HP is arranged opposite to the intermediate and low pressure sections IP and LP of the turbine. This is done to balance stage thrusts. Further, a thrust bearing B is installed between sections HP and IP. The size (area) of thrust bearing B is selected to ensure that under a wide range of operating conditions (e.g., the turbine's load, operating speed, temperature, and pressure levels within the turbine, etc.), the thrust pressure will fall within a predetermined range of values.

For the turbine of FIG. 1, step thrust is primarily developed in four packing regions: a packing N1 at the downstream end of low pressure section LP, a packing N2 at the upstream end of intermediate pressure section IP, and packings N3 and N4 at the respective upstream and downstream ends of high pressure section HP. The packings (or steam seals) are typically labyrinth type seals as is well known in the art, although other types of seals can be used. Further, as shown in FIG. 2, the packing for a particular section of the turbine comprises a number of sealing elements such as the labyrinth seals N3-1 to N3-7 shown in the Figure.

The step thrusts produced in sections IP and LP are relatively small because the pressures in these sections are relatively low (from atmosphere pressure to about 50 psi in section LP, up to about 400 in section IP). The largest step thrust occurs in the packing N4. This is because the diameter of rotor S sharply decreases at the transition from a last stage of high pressure section HP to the packing N4. Step thrust at packing N3 is subject to the next highest level of thrust due to the high pressure at this section. Because net thrust can build up to levels beyond the capability of thrust bearing B, the step thrust present at a specified location within the turbine has been used to equalize the thrust differential across rotor shaft S. This allows the thrust bearing to be of a reasonable size.

In steam turbine T, the packings N1–N4 work either as pressure packings to prevent higher pressure steam from leaking out into a room (not shown) where the turbine is housed, or as a vacuum packing preventing air from leaking into the turbine. As the operating load on turbine T increases, pressure in the high and intermediate sections, HP and IP respectively, of the turbine increases. Packings at the ends of these sections (the packings N2-N4 shown in FIG. 1) are now act as pressure packings. When the turbine is operating to cause gears to turn and a vacuum to be pulled, all of the packings (packings N1–N4) act as vacuum packings and function to minimize steam leakage loss.

Figure 2:
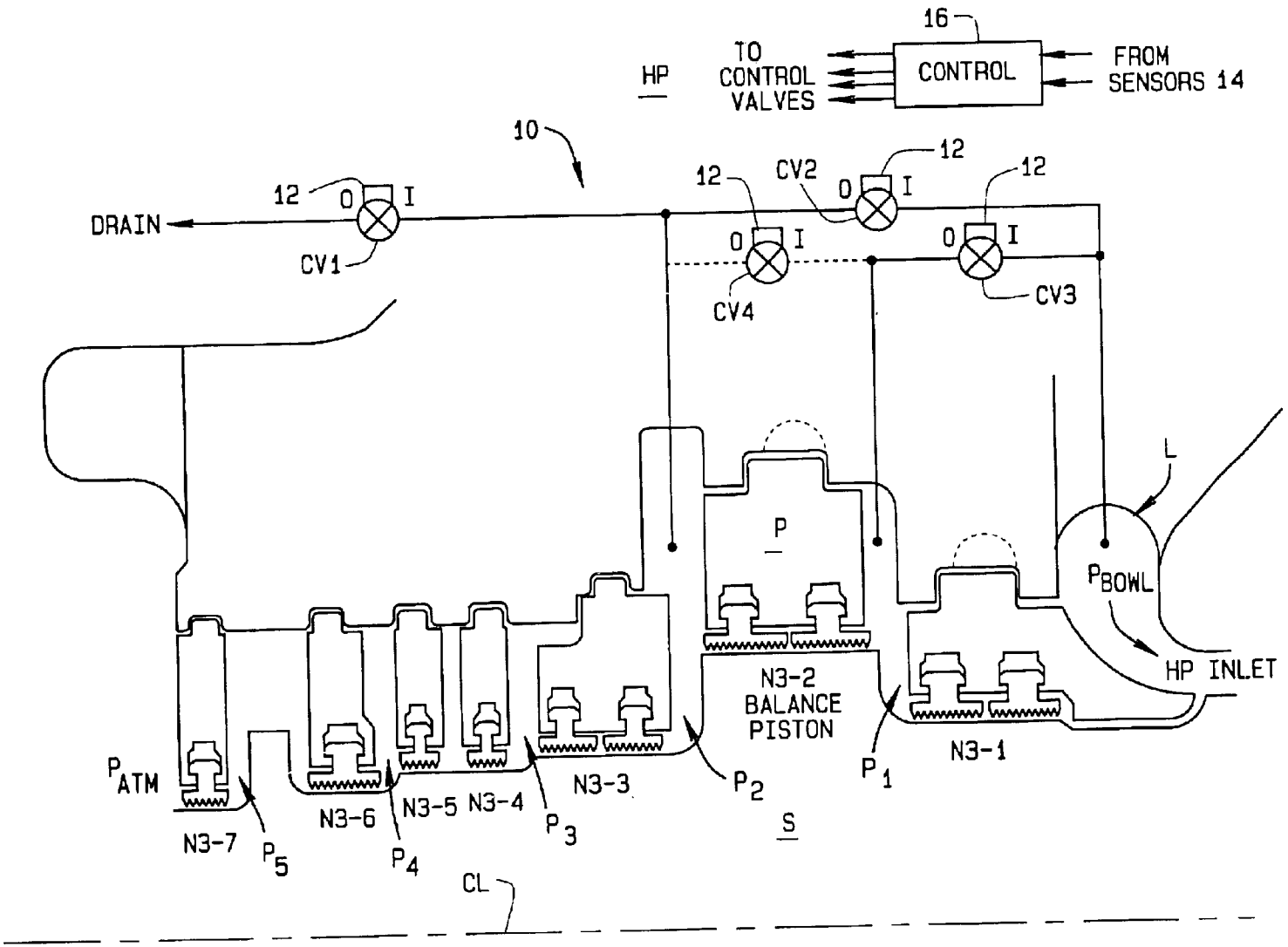
FIG. 2 illustrates a control valve arrangement of the present invention for thrust load control.

Referring to FIG. 2, the high pressure inlet to turbine section HP is indicated L and has a general bowl shape. As leakage flow passes a component of a seal packing (e.g., packing N3-1), a pressure differential builds up across the packing element. For example, if steam turbine T has a bowl pressure $P_{bowl}$ of 1930 psi at inlet L, a pressure $P_1$ on the downstream side of packing element N3-1 may be, for example, on the order of 920 psi, or $P_1$~920 psi. Similarly, the pressure on the downstream side of the next packing element N3-2 may be, for example, 540 psi, or and $P_2$~540 psi. Conventionally, the balance piston P in the high pressure section HP is used to control thrust of a steam turbine. Since balance pistons are known in the art, its construction and operation is not described.

Those skilled in the art will further understand that a pressure $P_3$ on the downstream side of packing element N3-3, a pressure $P_4$ on the downstream side of packing element N3-5, and a pressure $P_5$ on the downstream side of packing element N3-6 reflect similar changes in pressure through the high pressure section of the turbine. At the outlet end of the section, at the downstream side of packing element N3-7, the pressure $P_{atm}$ reflects the pressure at a drain port. Utilizing the various pressures, and ambient pressure, the net thrust of turbine T is controlled within allowable regions.

A net thrust control system of the present invention is indicated generally 10 in FIG. 2 and includes a plurality of solenoid control valves CV1–CV3, and an optional control valve CV4. As is well known in the art, solenoid valves are control devices used to automatically control pressures at packing components in the thrust control system of turbine T. When electrically energized or de-energized, the valves allow steam to either flow or stop. Each valve has an inlet I and an outlet O.

In FIG. 2, three solenoid valves CV1–CV3 are shown connected to components of packing N3. A first solenoid valve CV1 has its outlet connected to the drain portion of the turbine where the pressure is $P_{atm}$. The inlet of valve CV1 is connected to both the downstream side of balance piston P and its associated packing element N3-2 where the pressure is normally $P_2$, and to the outlet of control valve CV2. The inlet of control valve CV2 is connected to bowl L of the high pressure section HP of the turbine where the pressure is $P_{bowl}$. The third control valve CV3 has its inlet also connected to bowl L, and its outlet is connected to the downstream side of packing element N3-1 (the upstream side of balance piston P) where the pressure is $P_1$. Optionally, a fourth control valve CV4 is connected across balance piston P. It will be noted that there is a series/parallel arrangement of the control valves and that, in accordance with the invention, one or more of the control valves can be opened at one time to control net thrust of the turbine.

Figure 4A:
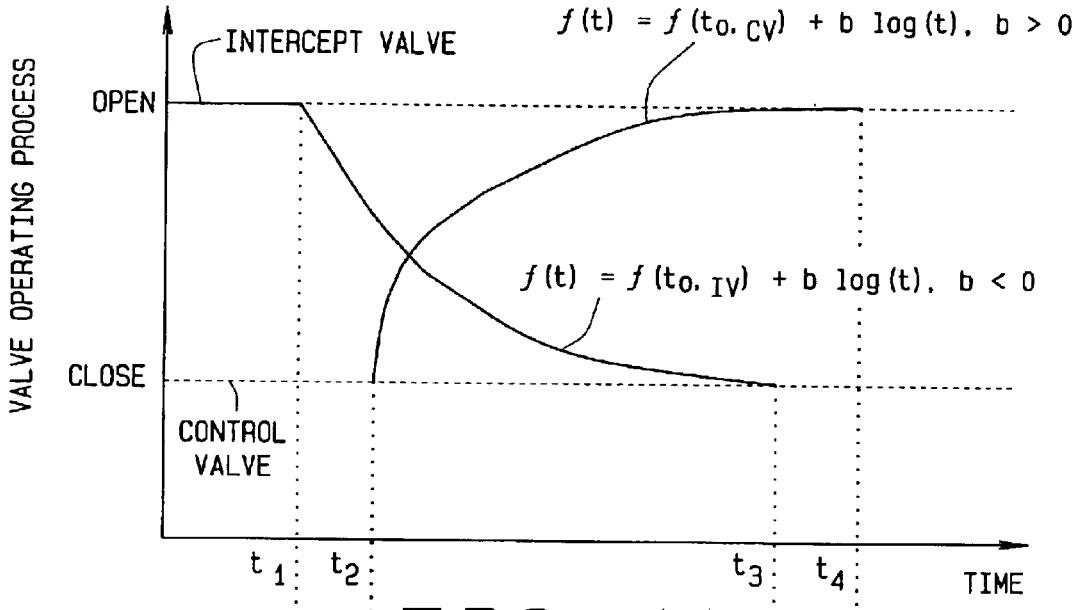
FIGS. 4*a* and 4*b* are graphs depicting thrust ranges under normal operating conditions of a turbine and under fault conditions; and, FIG. 5 is a flow diagram for the control system.
Figure 4B:
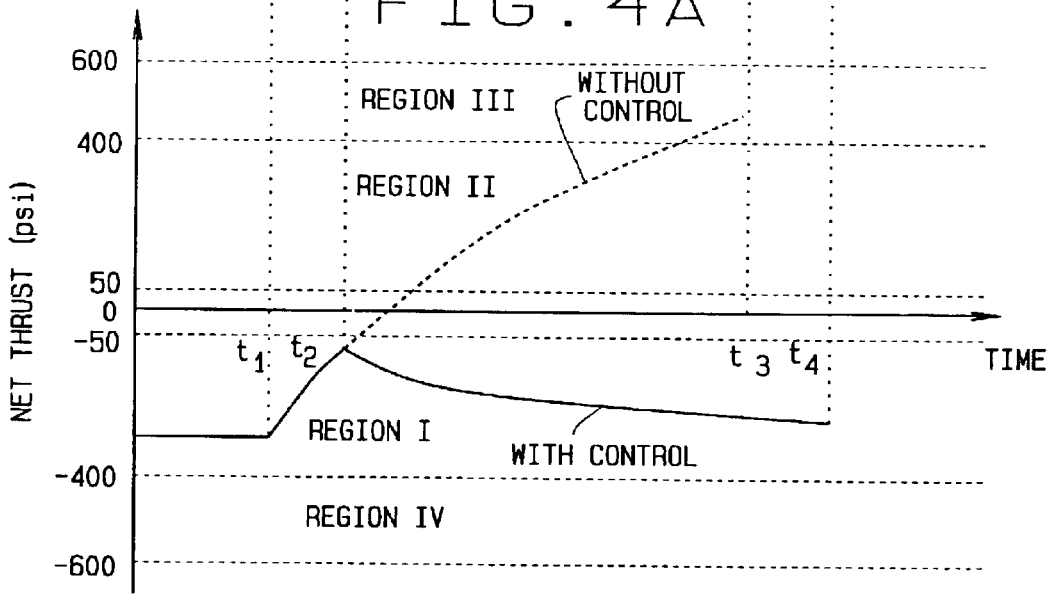

The control valves are normally closed and do not impact steam turbine operation. As shown in FIG. 4*b*, there are four identified regions of net thrust. Regions I and II which extend from −400 psi to 0, and from 0 to +400 psi respectively represent a normal operating range for the turbine. In Region I, thrust is toward the intermediate and low pressure sections IP and LP of the turbine, while in Region II, thrust is toward high pressure section HP. Those skilled in the art will understand that the point 0 psi may be crossed over from one direction to the other during operation of turbine T, but the transition is typically a gradual transition.

Under a fault condition, however, such as when an intercept valve (not shown) is closed, the load on thrust bearing B changes sharply. Referring to FIGS. 4*a* and 4*b*, during the time it takes for the intercept valve to close (times $t_1$ to $t_3$ in the Figures), net thrust decreases significantly. Without thrust control system 10, net thrust will not only keep moving from a minus psi value toward zero, but will rapidly pass through the 0 psi crossover point and change its direction from negative (i.e., toward intermediate and low pressure sections IP and LP) to positive (toward high pressure section HP). This is indicated by the dashed line in FIG. 4*b*. The result is the thrust load switching from one side of thrust bearing B to the other, and producing a large force impulse on the thrust bearing. This, in turn, can cause a crash between rotating and stationary components of the turbine due to the resulting axial displacement.

In operation, control valve CV1 of control system 10 is activated when net thrust falls to between 10–30% of its original value, but with the thrust still being within Region I of FIG. 4*b*. Referring to FIG. 2, it will be seen that with control valve CV1 open, the $P_2$ at the downstream side of balance piston P will approximate the drain pressure $P_{atm}$. As a result, the step thrust toward intermediate and low pressure sections IP and LP of the turbine can double or triple to balance the change in thrust.

It may be that in some situations, the generated step thrust will still not balance the thrust. In these circumstances, control valve CV3 is also opened so to increase pressure $P_1$ to pressure $P_{bowl}$, and produces a large pressure drop across balance piston P. By controlling the extent to control valves CV1 and CV3 are opened, net thrust can be precisely controlled within the allowable operation region (Region I in the above example). At this time, control valves CV2 and CV4 (if control valve CV4 is used) remain closed.

If the opposite situation to that described above occurs; that is, net thrust in the direction of the intermediate and low pressure sections IP and LP becomes too large, system 10 operates to open control valve CV2. This has the effect of making balance piston P nonfunctional (since the pressure differential ΔP across the balance piston becomes very small). Alternatively, instead of using control valve CV2, if control valve CV4 is used, opening this control valve has the same effect as opening control valve CV2.

In other situations, it may be desirable to open control valves CV1 and CV2, which are connected in series, so to connect bowl L of high pressure section HP to the environment or drain of the turbine. Because of the series/parallel connections of the control valves, different combinations of the control valves can be opened at any one time as operating circumstances warrant to control net thrust load.

Figure 3:
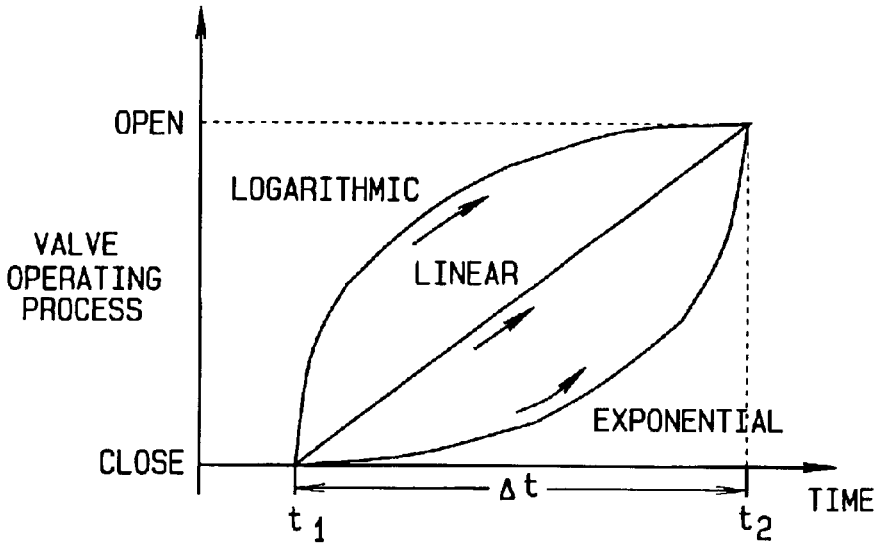
FIG. 3 is a graph illustrating control valve operation under different conditions.

Most commercially available solenoid valves open and close substantially instantaneously. This can cause very large shock pressures within control system 10, and potentially damage the control valves, especially at high flow velocities. To address this problem, control valves CV1–CV4 include dampeners 12 by which the valves can be opened and closed in a predetermined manner during a time interval Δt. This is accomplished by inputs to the control valves from a controller 16. In FIG. 3, three possible paths to open and close a control valve are illustrated. These paths include linear, exponential, and logarithmic paths. While each path may have certain advantages with respect to the others, it has been found that the greatest sensitivity and effectiveness in operating a control valve, the logarithmic path is preferable. Those skilled in the art will appreciate, that certain of the control valves can be opened in accordance with one path while others are opened using a different path. Also, paths other than the three shown in FIG. 3 may be implemented without departing from the scope of the invention.

Referring again to FIGS. 4*a* and 4*b*, they illustrate the variation of the steam turbine net thrust as control system 10 acts in response to an intercept valve closing. For purposes of understanding operation of system 10, it is assumed that the closing rate of an intercept valve follows the logarithmic function of $f(t)=f(t_{o,IV})+b\ \log_a(t)$ for $b<0$, and the opening rate of a control valve CV follows the logarithmic function of $f(t)=f(t_{o,CV})+b\ \log_a(t)$ for $b>0$. In FIG. 4*a*, the intercept valve begins to close at time $t_1$ and reaches its fully closed position at time $t_3$. As the thrust reduction is detected; for example by sensors 14 shown in FIG. 1 positioned on opposite sides of thrust bearing B and supplying inputs to controller 16, control valve CV1 is commanded by the system to start opening at time $t_2$ (using one of the paths shown in FIG. 3) and to complete opening by time $t_4$. As shown in FIG. 4*b*, during the interval from time $t_1$ to time $t_2$, net thrust is changing, but for the entire interval from time $t_1$ to time $t_4$, the net thrust remains is in region I. This is important, because by actively or dynamically responding to an abrupt change of conditions within turbine T, the resulting forces imparted to the turbine are constrained within acceptable limits, and the turbine does suffer any damage resulting from the change.

Figure 5:
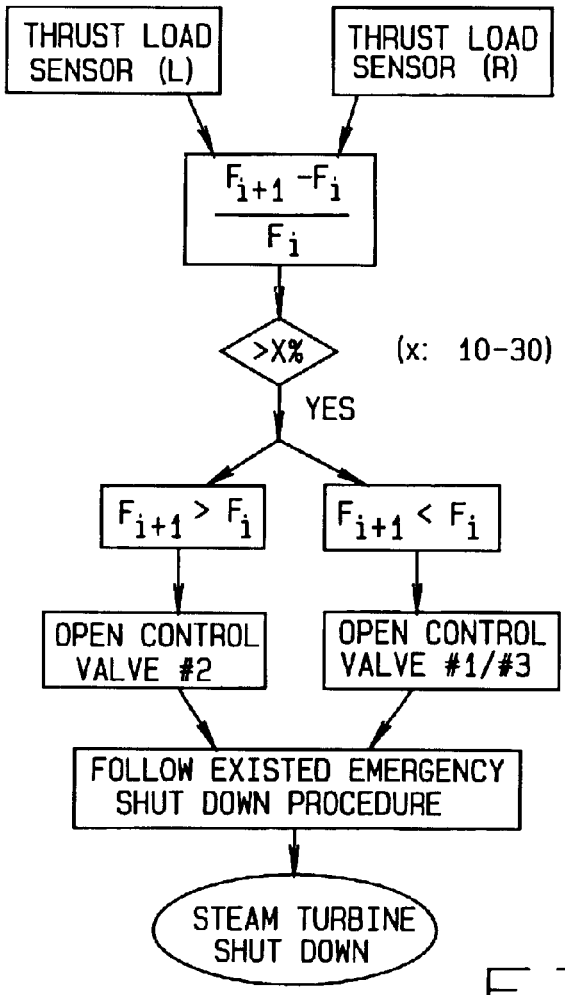

FIG. 5 is a flow diagram for system 10 and illustrates processing of the thrust load control. As noted, thrust load sensors 14 are installed at opposite sides of thrust bearing B to monitor and diagnose changes in thrust. During steam turbine T operation, only one side of thrust bearing B is loaded at any one time. Variation of thrust load is calculated from sensor 14 measurements as $$\eta = \frac{F_{t+1} - F_t}{F_t},$$

where $F_t$ is the sensed force at a point in time and $F_{t+1}$ is the sensed force at the next point in time.

When $|\eta|$ is between 10–30%, control system 10 is activated. According to the sign of the thrust differential (i.e., $F_{t+1}-F_t>0$ or $F_{t+1}-F_t<0$), one or more of the control valves are opened to balance the thrust. Again, this dynamic response to changed conditions avoids a thrust reversal with thrust load changing from one side of thrust bearing B to the other, and provides necessary time for steam turbine T to shut down following a normal procedure.

While the invention has been described in connection with a fault condition (intercept valve closing), those skilled in the art will recognize that control system 10 of the invention can also be used with a steam turbine under normal operation of the turbine. Further, while control system 10 has been described with respect to high pressure section HP of turbine T, the control system can also be employed in either or both the intermediate and low pressure sections IP and LP of the turbine.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. Apparatus (10) for controlling net thrust in a steam turbine (T) in response to changes in the operating condition of the turbine, the turbine including a thrust bearing (B) positioned between low and intermediate pressure sections (LP, IP) of the turbine and a high pressure section (HP) thereof, the apparatus comprising:

sensing means (14) continuously sensing loads on the thrust bearing;

valve means (CV1–CV3) for balancing pressures between locations within the high pressure section of the turbine; and, control means responsive to the sensing means sensing a change within the turbine indicative of a significant change in net thrust to activate the valve means and, using only internal pressure within the turbine, adjust the pressure within the high pressure section of the turbine and maintain the net thrust within a predetermined range of thrust and prevent damage to the turbine.

2. The apparatus of claim 1 in which the valve means includes a plurality of control valves each of which has a pressure inlet and a pressure outlet, the control valve inlet being connected to a higher pressure region of the high pressure section of the turbine than the outlet of the control valve.

3. The apparatus of claim 1 in which the high pressure section of the turbine includes a balance piston (p), and the valve means further includes control valve (CV4) having its pressure inlet on the upstream side of the balance piston and it pressure outlet on the downstream side thereof, thereby to balance the pressure across the piston when the control valve is activated.

4. The apparatus of claim 2 in which the sensing means includes a load sensor (14) located on opposite sides of the thrust bearing, an output from each load sensor being supplied as an input to the control means.

5. The apparatus of claim 4 in which the control means calculates a change in thrust load between one point in time and another point in time and activates at least one control valve in response thereto if the change in thrust load exeeds a predetermined limit.

6. The apparatus of claim 5 in which the control means controls opening of a control valve along a predetermined opening path.

7. The apparatus of claim 6 in which the control means controls opening of a control valve using a linear opening path.

8. The apparatus of claim 6 in which the control means controls opening of a control valve using an exponential opening path.

9. The apparatus of claim 6 in which the control means controls opening of a control valve using a logarithmic opening path.

10. The apparatus of claim 1 which is also usable in either or both of the low and intermediate pressure sections of the turbine.

11. In a steam turbine (T) having a low pressure section (LP), an intermediate section (IP), and a high pressure section (HP), a thrust bearing (B) being positioned between the high pressure section and the low and intermediate pressure sections, apparatus (10) for dynamically controlling a resultant net thrust of the turbine (T) caused by changes in the operating condition of the turbine so to maintain the net thrust within a predetermined acceptable range of thrust, the apparatus comprising:

sensing means (14) continuously sensing loads on the thrust bearing;

valve means (CV1–CV3) for balancing pressures between locations within at least one of the sections of the turbine; and, control means responsive to the sensing means sensing a change within the turbine indicative of a change in net thrust which exceeds a predetermined limit to activate the valve means and, using only internal pressure within the turbine, balance the pressure within the section of the turbine so to maintain net thrust within the acceptable range and prevent damage to the turbine.

12. The apparatus of claim 11 in which the valve means is located within the high pressure section of the turbine.

13. The apparatus of claim 11 further including a packing for sealing the section against steam flow, the packing being comprised of packing elements located at intervals along the length of the section and the valve means includes a plurality of control valves (CV1–CV3) for balancing the pressure on both sides of a packing element.

14. The apparatus of claim 13 in which the turbine section includes a balance position (P), and the valve means further includes a control valve (CV4) having its pressure inlet on the upstream side of the balance piston and its pressure outlet on the downstream side thereof, thereby to balance the pressure across the piston when the control valve is activated.

15. The apparatus of claim 13 in which the sensing means includes a load sensor (14) located on opposite sides of the thrust bearing, an output from each load sensor being supplied as an input to the control means.

16. The apparatus of claim 15 in which the control means calculates a change in thrust load between one point in time and another and activates at least one control valve in response thereto if the change in thrust load exceeds a predetermined limit.

17. The apparatus of claim 16 in which the control valves are connected in a series/parallel configuration for opening of one or more of the valves to balance the pressure between intervals of section across which the control valve is connected.

18. The apparatus of claim 17 in which the control means controls opening of a control valve along a predetermined opening path which is one of either a linear path, an exponential path, or a logarithmic path.

19. A method of dynamically controlling the net thrust within a steam turbine (T) comprising:

continuously measuring the loads on opposite sides of a thrust bearing (B) on one side of which are located low and intermediate pressure sections (LP, IP) of the turbine and on the other side of which is a high pressure section (HP) of the turbine;

calculating changes in the thrust load of the turbine between two points in times;

determining if any calculated change in thrust load exceeds a predetermined limit the result of which will cause the net thrust to move outside of a range of acceptable net thrust; and, activating a control valve (CV) in at least one section of the turbine to timely balance pressures within that section using only internal pressure within the turbine, balancing of the pressures maintaining the net thrust within the acceptable range and preventing damage to the turbine.

20. The method of claim 19 further including a plurality control valves (CV1–CV4) located in the high pressure section of the turbine, at least one of the control valves being activated to balance the pressures within the high pressure section.

21. Apparatus (10) for controlling net thrust in a steam turbine (T) in response to changes in the operating condition of the turbine, the turbine including a thrust bearing (B) positioned between low and intermediate pressure sections (LP, IP) of the turbine and a high pressure section (HP) thereof, the apparatus comprising:

sensing means (14) continuously sensing loads on the thrust bearing;

valve means (CV1–CV4) for balancing pressures between locations within the high pressure section of the turbine;

control means responsive to the sensing means sensing a change within the turbine indicative of a significant change in net thrust to activate the valve means to adjust the pressure within the high pressure section of the turbine and maintain the net thrust within a predetermined range of thrust and prevent damage to the turbine; and, the high pressure section of the turbine including a balance position an a control valve (CV4) of the valve means having its pressure inlet on the upstream side of the balance piston and its pressure outlet on the downstream side thereof, thereby to balance the pressure across the piston when the control valve is activated.

22. Apparatus (10) for controlling net thrust in a steam turbine (T) in response to changes in the operating condition of the turbine, the turbine including a thrust bearing (B) positioned between low and intermediate pressure sections (LP, IP) of the turbine and a high pressure section (HP) thereof, the apparatus comprising:

sensing means (14) continuously sensing loads on the thrust bearing and including a load sensor (14) located on opposite sides of the thrust bearing;

valve means (CV1–CV3) for balancing pressures between locations within the high pressure section of the turbine and including a plurality of control valves each of which has a pressure inlet and a pressure outlet, the control valve inlet being connected to a higher pressure region of the high pressure section of the turbine than the outlet of the control valve; and, control means responsive to an output from each load sensor sensing a change within the turbine indicative of a significant change in net thrust to activate the valve means to adjust the pressure within the high pressure section of the turbine and maintain the net thrust within a predetermined range of thrust and prevent damage to the turbine.

23. In a steam turbine (T) having a low pressure section (LP) an intermediate section (IP), and a high pressure section (HP), a thrust bearing (B) being positioned between the high pressure section and the low and intermediate pressure sections, apparatus (10) for dynamically controlling a resultant net thrust of the turbine (T) caused by changes in the operating condition of the turbine so to maintain the net thrust within a predetermined acceptable range of thrust, the apparatus comprising:

sensing means (14) continuously sensing loads on the thrust bearing;

valve means (CV1–CV4) for balancing pressures between locations within at least one of the sections of the turbine;

a packing for sealing the section against steam flow and including packing elements located at intervals along the length of the section, with control valves (CV1–CV3) of the valve means balancing the pressure on both sides of a packing element;

control means responsive to the sensing means sensing a change within the turbine indicative of a change in net thrust which exceeds a predetermined limit to activate the valve means and balance the pressure within the section of the turbine so to maintain net thrust within the acceptable range and prevent damage to the turbine; and, a balance position (P) installed in the section with a control valve (CV4) of the valve means having its pressure inlet on the upstream side of the balance piston and its pressure outlet on the downstream side thereof, thereby to balance the pressure across the piston when the control valve is activated.

* * * * *

UNITED STATES PATENT AND TRADEMARK OFFICE

CERTIFICATE OF CORRECTION

PATENT NO. : 6,957,945 B2
DATED : October 25, 2005
INVENTOR(S) : Wei Tong and Christian Vandervort It is certified that error appears in the above-identified patent and that said Letters Patent is hereby corrected as shown below:

Column 8,
Line 8, replace “exeed” with -- exceeds --.

Column 9,
Line 32, after “plurality” and before “control” insert -- of --.
Line 57, replace “an” with -- and --.

Signed and Sealed this

Twenty-fourth Day of January, 2006

JON W. DUDAS
*Director of the United States Patent and Trademark Office*